US005240337A

United States Patent [19]

Gruner

[11] Patent Number: 5,240,337

[45] Date of Patent: Aug. 31, 1993

[54] COSMETIC STICK HOLDER

[75] Inventor: Claus Gruner, Bad Blankenburg, Fed. Rep. of Germany

[73] Assignee: Rocma Concepts GmbH Beratung und Vertrieb für die kosmetische Industrie, Bad Blankenburg, Fed. Rep. of Germany

[21] Appl. No.: 833,783

[22] Filed: Feb. 12, 1992

[51] Int. Cl.[5] ..... A45D 40/04

[52] U.S. Cl. ..... 401/78; 401/86

[58] Field of Search ..... 401/68, 69, 75, 77, 401/78, 86, 87

[56] References Cited

U.S. PATENT DOCUMENTS

| | | | |
|---|---|---|---|
| 2,333,812 | 11/1943 | Nyden | 401/78 |
| 3,083,823 | 4/1963 | Metreaud | 401/78 |
| 3,146,881 | 9/1964 | Metreaud et al. | 401/75 |
| 3,623,821 | 11/1971 | Gould | 401/86 |
| 3,623,822 | 11/1971 | Davidson | 401/78 |
| 3,758,218 | 9/1973 | Pfrommer et al. | 401/86 |
| 4,505,607 | 3/1985 | Sugiyama | 401/78 |
| 4,666,324 | 5/1987 | Oses | 401/68 X |

FOREIGN PATENT DOCUMENTS

| | | |
|---|---|---|
| 0428794 | 5/1991 | European Pat. Off. . |
| 853306 | 11/1960 | Fed. Rep. of Germany . |
| 2663521 | 12/1991 | France . |
| 314497 | 7/1956 | Switzerland . |

*Primary Examiner*—Danton D. DeMille

*Attorney, Agent, or Firm*—Beveridge, DeGrandi, Weilacher & Young

[57] ABSTRACT

A cosmetic stick holder, such as a lip stick holder, features a cosmetic stick mechanism having a piston supporting the cosmetic stick. The cosmetic stick is extended or retracted into the cosmetic stick mechanism upon rotation of a screwing sleeve forming part of the cosmetic stick mechanism. The screwing sleeve is exchangeably held with its foot part in an outer cap member by a releasable lock having two locking parts provided on the outer cap member and the foot part so as to prevent axial movement of the foot part and cap member and to provide for release of the two upon rotation of the foot part with respect to the cap member when the piston is fully retracted.

16 Claims, 2 Drawing Sheets

COSMETIC STICK HOLDER

FIELD OF THE INVENTION

The invention relates to a cosmetic stick holder that comprises a cosmetic stick mechanism. The cosmetic stick mechanism has a piston for carrying the cosmetic stick, a slot sleeve, in which the piston is displaceable and which is provided with a longitudinal slot, and a screwing sleeve which is formed with a thread groove and in which the slot sleeve is rotatingly contained. A lug formed at the piston extends through the longitudinal slot up into the thread groove of the screwing sleeve. The slot sleeve extends out of the screwing sleeve to form a foot part. The invention further includes an outer cap member, in which the cosmetic stick mechanism is held by the foot part of the slot sleeve and from which the screwing sleeve projects in turn rotatably, in such a way, that the piston is displaceable in the slot sleeve by rotating the screwing sleeve relative to the outer cap member in one rotating direction towards the end of the slot sleeve opposite to the foot part up to a first end position, and in the other direction back towards the foot part up to a second end position and is held in the end positions against a further displacement.

BACKGROUND DISCUSSION

By such a displacement of the piston by rotating the screwing sleeve relative to the outer cap member the cosmetic stick, which can be a lipstick, a deodorant stick or the like, and which is supported with its foot by the piston, is moved out of the open end of the slot sleeve and, respectively, is moved into the slot sleeve again. The outer cap member serves as the lower part of a protective casing, which in most cases is designed as a decor casing. In order to hold the foot part of the slot sleeve in the outer cap member with a simultaneous rotatability of the screwing sleeve relative to the outer cap member a central socket can be mounted at its bottom, a socket which engages quite firmly into a central hole of the foot part. This, however, has the consequence that the assembly looked in the outer cap member and called herein a "cosmetic stick mechanism" can only be released with effort and strength after the consumption of the cosmetic stick by axially pulling the cosmetic stick mechanism out of the outer cap member and therefore the outer caps are generally thrown away with the empty cosmetic stick mechanism and thus the outer caps were prevented from being designed as relatively precious ornaments.

SUMMARY OF THE INVENTION

By means of the invention, the problem of designing a cosmetic stick holder in a way that the outer cap members can be used again, is solved. Thus, the present invention provides a solution which is not only beneficial for environmental protection because of the reduction of garbage, but which also enables the outer cap members to be designed as more or less precious ornaments.

According to the invention, the cosmetic stick mechanism is exchangeably held in the outer cap member by a releasable lock comprising two locking parts which are designed at the outer cap member at the one hand, and at the foot part of the slot sleeve at the other hand and which engage each other in a way that the outer cap member and the foot part are held together at least axially, and which by a relative rotation of the outer cap member on the one hand and of the foot part by means of the screwing sleeve on the other hand are releasable from each other when the piston is held in one of its end positions.

The resistance against said relative rotation for unlocking the lock must be greater than the resistance against the rotation of the screwing sleeve relative to the outer cap member for the movement of the cosmetic stick out of and back into the slot sleeve, so as to avoid unintentionally releasing the lock. Since, however, the piston is held in its end positions preferably by a stop, the screwing sleeve is locked with the cosmetic stick mechanism by the lugs of the piston in one of the rotating directions, whereby the relative rotation for releasing the lock in this locked direction of rotation can be performed even against a greater resistance. Advantageously, the direction of rotation for releasing the lock is the same as the direction of rotation of the screwing sleeve, in which the retraction of the cosmetic stick into the slot sleeve is performed, whereby the releasing of the lock can be performed, when the piston is held in its lower end position.

Preferably, one of the locking members is a radial projection and the other locking part is an axial shoulder acting as a seat for the radial projection which, when the piston is held in one of its end positions, can axially be locked at and unlocked from the axial shoulder by a relative rotation of the outer cap member on the one hand and of the foot part via the screwing sleeve on the other hand. Axially between the two construction parts comprised of the foot part and the outer cap member one construction part is formed with an elastic member being positioned between the construction parts and pushing the construction parts axially apart.

In this embodiment of the invention there is therefore provided a bayonet-like locking device between the outer cap member and the foot part, wherein the radial projection and the axial shoulder can be held in a sufficiently strong mutual engagement because of the elastic force of the elastic member, so that the screwing sleeve can be rotated for the use of the cosmetic stick relative to the outer cap member and thus to the slot sleeve without an unintended releasing of the locking by rotating back the foot part.

When the radial projection is formed at the outer cap member and the axial shoulder is formed at the foot part of the slot sleeve, the axial shoulder is averted from the cap bottom member and the radial projection grips over it. If, vice versa, the radial projection is formed at the foot part and the axial shoulder is formed at the outer cap member, the axial shoulder points to the cap bottom and the radial projection grips under it. Although the radial projection can be shaped as an axially extended rib, its design as a lug, especially as a round lug, is preferred.

The elastic member can, for example, be shaped as an elastic vault of the bottom of the outer cap member or of the foot part of the slot sleeve. Further, it is possible to form one or more projections at the inner side of the bottom of the outer cap member and to provide the elastic member as a springingly yielding bottom of the foot part. This possibility is especially suitable, if the outer cap member is deep drawn of a metal material and if the projections at the cap bottom are formed as a depression. The foot part can be produced from a plastic material and can be springingly deformed by means of the projections. It is possible, too, that the elastic member is formed as a springingly yielding tongue formed at one of the construction parts, comprising a projection arranged eccentrically with respect to the rotating axis of the screwing sleeve. The preferably rounded projection engages with a complementary locking recess formed in the Other construction part. Hereby, an additional protection against rotation of the foot part is achieved, which enables the elastic member to be designed for little spring tension. This possibility for designing the elastic member is preferred if the outer cap member is made of plastic material.

The mutually engaging surfaces of the radial projection and of the axial shoulder can be plane-shaped, if the frictional force between them in the locking position is sufficient in order to prevent their unintended turning apart with the rotating of the screwing sleeve, or the foot part is held back by other means, such as by the above mentioned rotating protection mechanism via the elastic tongue against a rotation of the screwing sleeve when it is normally operated. A measure of this kind, which is indeed preferred, is that the axial shoulder is shaped as a snapping depression and the radial projection is shaped as a round lug, so that even here in this locking position there o is a certain closing form or positive engagement against a rotation of the foot part. This closing form can, however, be overcome for an intended unlocking of the foot part due to a yielding of the elastic member.

In a preferred development of the invention, the construction part comprising the axial shoulder has a guiding groove opening at one side of the axial shoulder for the radial projection formed as a round lug, the groove being axially open at the end opposite to the axial shoulder and from the groove the round lug can be turned out until it engages the axial shoulder. Such a kind of design is favorable especially for a space-saving shape of the guiding groove and the axial shoulder in the circumferential wall of the foot part of the slot sleeve. Although the guiding groove can be axially positioned, the guiding groove is preferably positioned obliquely to the axial direction, so that the round lug is screwingly rotated into the outer cap member when inserting the cosmetic stick mechanism into the outer cap member in a way that the foot part is screwed into the outer cap member with the same rotating direction as the direction of the relative rotation for the axial locking of the radial projection at the axial shoulder. In a further embodiment of the invention, there is opening a second guiding groove for the round lug at the other side of the axial shoulder, the second guiding groove being axially open at the end opposite to the axial shoulder and into which the round lug can be rotated out of engagement with the axial shoulder. It is especially preferred that the second guiding groove is shaped at the side of the axial shoulder which is opposite to the rotating direction of the screwing sleeve when the piston is displaced back towards the foot part. Hereby it is possible to execute the locking of the foot part in the outer cap member as also the unlocking of the same by uniform rotating movements in the lowest position of the piston, in which the cosmetic stick is completely retracted into the slot sleeve, and the screwing sleeve can only be rotated further in common with the foot part. Hereby, a safe locking and unlocking of the cosmetic stick mechanism can be achieved, the cosmetic stick hereby not being able to be moved. Although the second guiding groove can also be extended obliquely to the axial direction or can be positioned deviating from the axial direction, it is preferably positioned parallel to the axial direction, so that the cosmetic stick mechanism can be axially drawn out of the outer cap member after releasing the lock. By such a measure it is favored to provide—according to the invention—two locking devices being diametrically opposed to the cosmetic stick holder without any constructive restrictions.

With the shaping of the axial shoulder and of the radial projection at a tip-stretched extension protruding from the inner wall of the outer cap member at a distance from its cap bottom there are in general overlappings in the outer cap member. Those can, however, be mastered with respect to the tools, when producing the outer cap member of plastic material, by forming an opening in the cap bottom of the outer cap member axially aligning with the tip-streched projection, the opening being shaped during the injection molding of the outer cap member by a bar-like tool slide to form the overlapping and by means of which the tool slide being able to be pulled out again after the injection molding of the outer cap member. This tool slide can also be designed to form the lateral sides of a springingly yieldable tongue in the cap bottom as said elastic member.

According to another development of the invention, the lock can be formed even as an axial plug connection of which one of the construction members formed of the foot part and of the outer cap member has a central opening and the other construction member has at least one axial projection rotatingly plugged into the central opening and engaged with the edge of the central opening, and wherein at the circumference of one of said construction members an oblique shoulder is formed and at the other construction member a counter part is formed, which slidably engages the oblique shoulder. The oblique shoulder and the counter part are slidable upon each other during said relative rotation for releasing the locking members and axially pressing apart the foot part and the outer cap member.

In this embodiment, therefore, the insertion of the cosmetic stick mechanism and of the outer cap member can be performed in an axial direction, which in most instances can be done without a greater exertion. Since however, an axial pulling of the cosmetic stick mechanism out of the outer cap member can be relatively difficult, especially if the diameter thereof is relatively small, the oblique shoulder and the counter part thereof enable a more simple releasing of the plug connection by a rotational movement of the cosmetic stick mechanism relative to the outer cap member, whereby the same can be quasi screwingly disconnected. Further, in the locking position, the oblique shoulder and the counter part thereof form a protection against rotation of the foot part of the cosmetic stick mechanism in the outer cap member. The axial projection and the central opening can engage each other by friction force. However, o it is also possible, to construct the same in such a way, that they are positively locked in the locking position. For this, especially a plurality of elastic tongues, arranged in a circle and formed with outer locking projections at the free ends thereof can be provided, which snap in behind the edge of the central opening.

BRIEF DESCRIPTION OF THE DRAWINGS

The invention is explained further by means of two embodiments preferred at the moment, which is evident at least schematically in the drawings. In the drawings.

DETAILED DESCRIPTION OF THE PREFERRED EMBODIMENTS

Figure 2:
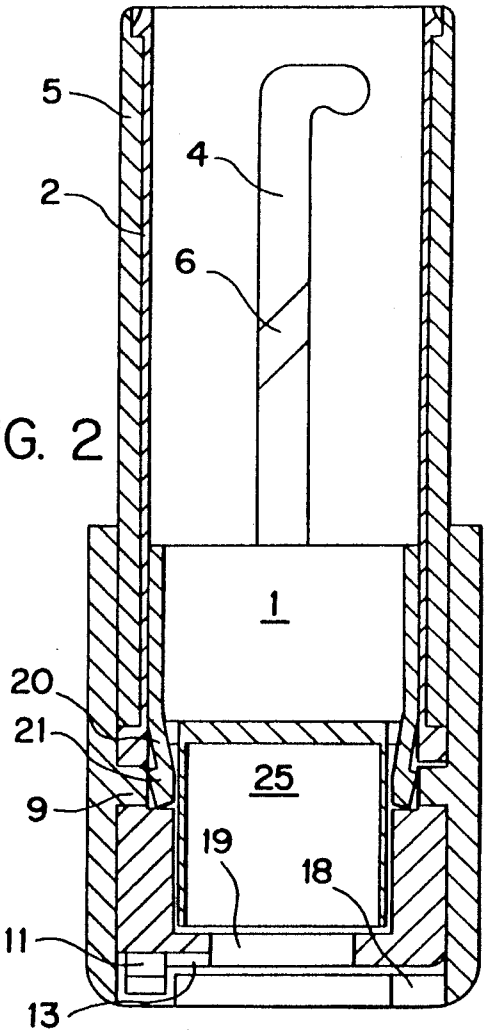
FIGS. 1 and 2 show different axial sections of a cosmetic stick holder with a cosmetic stick mechanism in an outer cap member according to the first preferred embodiment of the invention.
Figure 3:
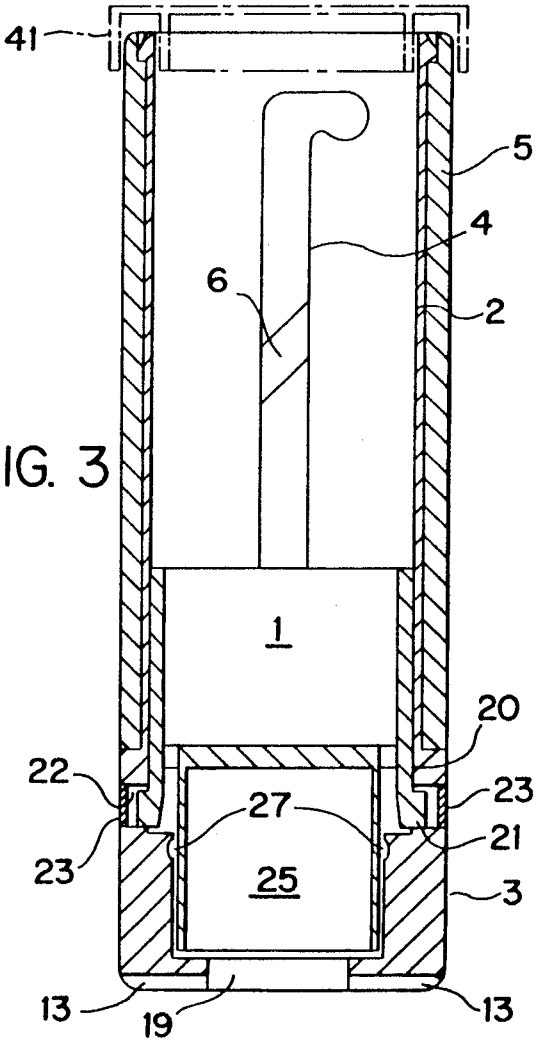
FIG. 3 shows an axial section of the cosmetic stick mechanism of FIG. 2, but before its insertion into the outer cap member.
Figure 1:
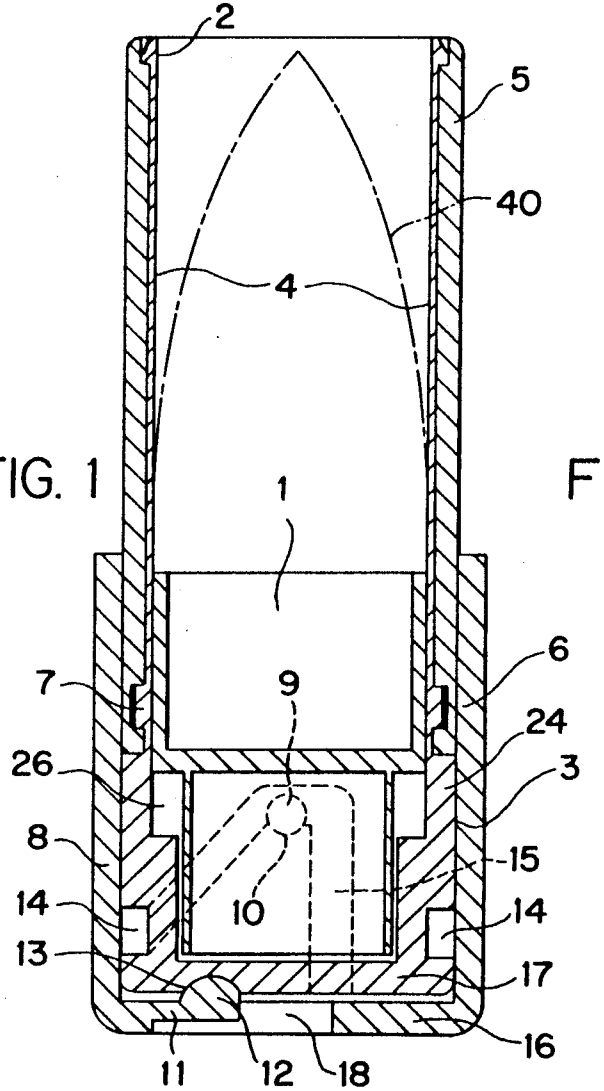

As it is shown in FIGS. 1-3, a cup-shaped piston 1 carrying a cosmetic stick (not shown) is movable in a slot sleeve 2 which itself is rotatably contained in a screwing sleeve 5. In the slot sleeve 2 two diametrically opposed longitudinal slots 4 are formed. In the inner walls of the screwing sleeve 5 there are formed two opposed thread grooves 6 with a relatively great pitch. The piston i has at its outer wall two diametrically opposed lugs 7 projecting in radially outward direction, which extend through the longitudinal slots 4 of the slot sleeve 2 up into the corresponding thread groove 6 of the screwing sleeve 5. Therefore, when the screwing sleeve 5 is rotated about the slot sleeve 2, the lugs 7 are moved in the longitudinal slots 4 by the trailing edge of the corresponding thread groove 6 whereby the piston 1 is axially shifted in the slot sleeve 2 and therefore the cosmetic stick is moved out of the open end of the slot sleeve 2, and, respectively, is moved back into the slot sleeve 2.

In the embodiment shown in FIGS. 1 to 3 as a preferred example, the slot sleeve 2 axially extends beyond the screwing sleeve 5 with a cup-shaped foot part 3 with a central opening 19 in the bottom 17 of the foot part 3, whereby the slot sleeve 2 can be rotated relative to the screwing sleeve 5 by means of engagement at the same and furthermore at the foot part 3. The outer diameter of the foot part 3 corresponds to that of the screwing sleeve 5. The lower section of the circumferential wall 24 of the foot part 3 is thickened at the inner side. From the lower surface of piston 1, a cylinder projection 25, the outer diameter of which is less than that of the piston 1, projects in the lowest position of the piston 1—as it is shown in the drawing—into the cylinder space, which is bordered by the thicker section of the circumferential wall of the foot part 3, and engages according to FIG. 3 in this lowest position into the thicker section of the circumferential wall with small snapping knobs 27 in snapping recesses, so that it is recognizable by the snapping of the snapping knobs 27 into corresponding snapping recesses when the piston 1 has reached its lowest position.

The cosmetic stick mechanism is inserted with the foot part 3 of the slot sleeve 2 and the lower part of the screwing sleeve 5 into an outer cap member 8 shaped in the example like a cylindrical pot (other shapes thereof are possible, too), in which the screwing sleeve is rotatable, but in which the foot part 3 is held axially and against rotation. To this purpose, two radial projections shaped as round lugs 9 are formed at the inner wall of the outer cap member 8 at a distance from the cap bottom 16 and diametrically opposed with respect to the outer cap member 8. At the outer circumference of the foot part 3 there is formed for each of the round lugs 9 a guiding groove 14 extending in its circumferential wall 24 obliquely to the axial direction, the lower end of the groove being axially open at the lower side of the bottom of the foot part. The guiding groove 14 is closed at its radial bottom along the thicker section of the circumferential wall of the foot part 3 and extends above the thicker section of the circumferential wall as a radial slot and opens at one side of an axial shoulder 10, which is shaped as a snapping hollow for the corresponding round lug 9 and is axially pointing to the open end of the outer cap member 8. A second guiding groove 15, which is axially positioned in the circumferential wall 24 of the foot part 3 and which is also open at the lower side of the foot part, opens at the other side of the axial shoulder 10.

Elastic tongues 11 are formed in the cap bottom 16 at the periphery thereof, the tongues 11 having a rounded projection 12 positioned eccentrically with respect to the cap axis, the projection protruding at the inner side of the cap bottom 16. The projections 12 are opposed diametrically to the outer cap member 8. At the lower side of the bottom 17 of the foot part 3 there are formed in the latter two recesses 13 being diametrically opposed, which interact with the projections 12 for the snapping of the foot part 3 against rotation, when the cosmetic stick mechanism is set into the outer cap member 8. The elastic tongues 11 additionally serve to press apart the cap member 8 and the foot part 3 thereby pressing the round lugs 9 into their seats 10.

In the embodiment shown, the outer cap member 8 is an injection molded part of plastic material. In the area of the periphery of the bottom 16 of the cap member 8 there are shaped two openings 18, each of which is axially aligned with one of the round lugs 9, so that the lower side of the round lugs 9 can be formed by means of bar-shaped tool slides during the injection molding of the outer cap member. Also, the lateral contours of the elastic tongues are formed by the tool slides.

For inserting the cosmetic stick mechanism into the outer cap member 8 the cosmetic stick mechanism is turned with its foot part 3 into the outer cap member 8 in that direction which corresponds to the relative turning of the screwing sleeve 5 relative to the slot sleeve 2 for retracing the piston 1 into the slot sleeve 2. Hereby, the round lugs 9 of the outer cap member 8 enter into the open ends of the oblique guiding grooves 14 and are displaced in the guiding grooves 14 upon the further turning movement, until the round lugs 9 snap into the depression of the axial shoulder 10. Under the spring force of the elastic tongues 11 the round lugs 9 are held back in the depression of the axial shoulders 10 against a further turning movement. At the same time, the projections 12 of the elastic tongues 11 have snapped into the corresponding recesses 13. The result is that the foot part 3 is held back axially at the axial shoulder 10 and is held against rotation in the cap member 8 under the spring force of the elastic tongues 11 due to the hollow form of the axial shoulders 10 and the snapping engagement of the projections 12 of the elastic tongues 11 into the corresponding recesses 13. Thereby, the piston 1 can be displaced by turning the screwing sleeve 5 with respect to the outer cap member 8 and thus to the slot sleeve 2 for moving the cosmetic stick out of and into the slot sleeve 2, respectively, without releasing the foot part 3 from the outer cap member 8. If, however, the piston 1 is in the position in which it is pushed farthest into the slot sleeve 2, the locking of the cosmetic stick mechanism can be released by a further turning of the screwing sleeve 5 with respect to the outer cap member 8 in the same turning direction, whereby the round lugs 9 enter into the second guiding groove 15, and the cosmetic stick mechanism can axially be drawn out of the outer cap member 8.

In the extension of the circumferential wall of the cup-shaped piston 1 there are mounted at the piston 1 two elastic tongues 20 pointing downwards, which are positioned in the ring space 26 between the cylinder projection 25 and the upper section of the circumferential wall 24 of the foot part 3, and each of them is equipped with a locking projection 21 at the radially outer side. The elastic tongues 20 engage with their locking projections 21 into the locking openings 22 formed above the axial shoulder 10, if the cosmetic stick mechanism is not locked in the outer cap member 8. The locking projections 21 end with their radial front sides radially at a distance from the outer circumferential surface of the foot part 3 and are therefore sun in the locking openings 22 when seen from the outside. By the locking of the cosmetic stick mechanism in the outer cap member B, however, the locking projections 21 at the elastic tongues 20 are pushed out of engagement with the locking openings 22 by the round lugs 9, whereby the slot sleeve 2 and the screwing sleeve 5 can be rotated with respect to each other, after the cosmetic stick mechanism has been inserted. An oblique shoulder can be formed in the round lugs 9 and/or at the locking projection 21 of the elastic tongues 20 in order to push the locking projections 21 out of the locking openings 22, the oblique shoulder facilitating the pushing out of the locking projections 21.

Above the locking opening 22, there can be formed a small skin 23, as shown in FIG. 3, which is destroyed when the round lug 9 is turned into the axial shoulder 10. Thereby, a proof of originality is created which shows that with an undestroyed skin 23 the cosmetic stick in the cosmetic stick mechanism outside the outer cap member 8 has not yet been used.

As shown in FIG. 1 with dash and dot lines, the cosmetic stick can be provided, as known in the art, with a protection sleeve 40, which releases itself from the cosmetic stick after the first moving out of the piston 1. Additionally or alternatively it is possible, as shown in dash and dot lines in FIG. 3, to cover the open end of the cosmetic stick mechanism with a releasable protection cover 41.

Figure 5:
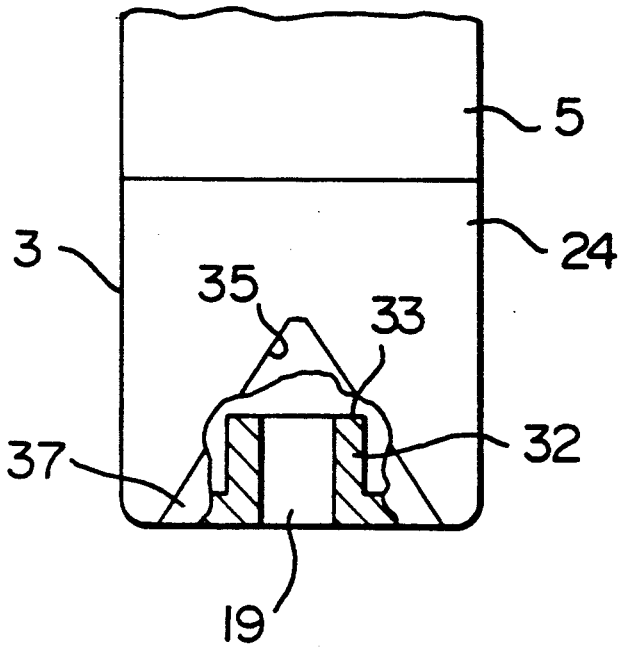
FIG. 5 shows a part view of the cosmetic stick mechanism of the second embodiment, partly in broken view.
Figure 4:
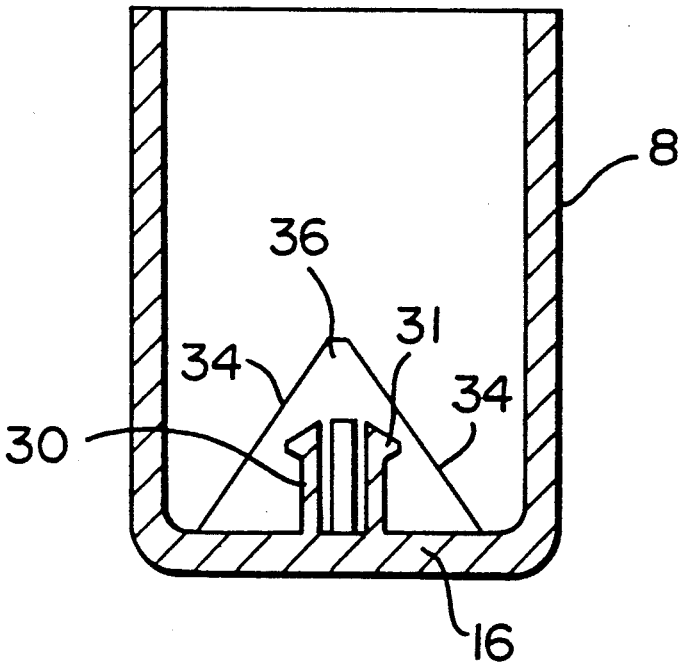
FIG. 4 shows an axial section of the outer cap member of the second preferred embodiment of the invention.

In the embodiment shown by FIGS. 4 and 5 the foot part 3 and the outer cap member 8 are locked to each other by means of an axial plug connection. To this end, the central opening 19 in this example is surrounded inside of the foot member 3 by a cylinder socket 32 projecting inside from the bottom 17 of the foot part and forming an axial shoulder 33 with its free face. At the inner side of the cap bottom 16 of the outer cap member 8, however, a plurality of axially projecting elastic shackles 30 are formed which are arranged in a circle and which each are formed at their free ends with a radial projection 31 projecting radially outwardly and having substantially the shape of nub which is radially outwardly inclined at its upper face. The arrangement of the spring shackles 30 is adapted to the diameter of the central opening 19 of the foot part 3 in such a way, that, during the axial insertion of the cosmetic stick mechanism into the outer cap member 8, the spring shackles 30 are deflected radially inwardly when the lower edge of the central opening abuts against the inclined faces of the radial projections 31 of the spring shackles 30, and pass the central opening 19, until they snap behind the axial shoulder 33 at the cylinder socket, thereby axially locking the cosmetic stick mechanism in the outer cap member 8. In this embodiment, too, it is possible to provide an elastic part like the elastic tongues 11 of the first embodiment axially between the foot part 3 and the outer cap member 8, in order that the radial projections 31 of the spring shackles 30 abut the axial shoulder 33 without play.

For releasing the snap-plug connection of the cosmetic stick mechanism in the outer cap member 8, the inner wall of the cap member 8 is formed with two diametrically opposed triangular radial projections 36, the tip of the triangle pointing axially upwards. Oblique shoulders 34 are formed by the triangle sides. On the other hand, radial recesses 37 complementary to the radial projections 36 are formed in the outer peripheral wall 24 of the foot part 3. The radial recesses 37 are open at their lower side and they likewise form oblique shoulders 35 at their triangle sides, the oblique shoulders 35 cooperating with the oblique shoulders 34 as counter pieces. Accordingly, if the cosmetic stick mechanism is rotated when the plug connection 31-36 is locked, the oblique shoulders 34, 35 slide one upon the other and axially push the foot part 3 and the outer cap member 8 apart, thereby releasing the radial projections 31 from the axial shoulder 33 and unlocking the plug connection. Thereafter, the cosmetic stick mechanism can axially be drawn out of the outer cap member 8 without exertion.

I claim:

1. A cosmetic stick holder, comprising:

a cosmetic stick mechanism which includes a) a screwing sleeve which has a thread groove, b) a slot sleeve which is received within said screwing sleeve and which includes both an axially extending slot and a foot part formed at a first end of said slot sleeve, and c) a piston for carrying a cosmetic stick, said piston being positioned within said slot sleeve and including a lug that extends through the slot and into the thread groove such that relative rotation of said slot sleeve and screwing sleeve displaces said piston axially between an extended position and a retracted position; and an outer cap member having an inner wall and a base which define an internal recess adapted to receive therein said foot part, said foot part including a central opening with an upper shoulder edge, and said outer cap member including an axial projection extending upwardly off from the base of said outer cap member, said axial projection being dimensioned for locking engagement within said central opening when said axial projection extends through said central opening upon said foot part being received within the recess of said outer member, and said outer cap member and foot part each including an oblique shoulder which are dimensioned and arranged such that relative rotation of said outer cap member and foot part forces said oblique shoulders into sliding contact wherein said cap member is axially forced way from said foot part such that said axial projection disengages from the central opening.

2. A cosmetic stick holder as recited in claim 1 wherein said axial projection includes outwardly biased spring shackles with each having a knob at a free end, and said foot part includes a cylindrical socket defining said central opening and having an upper rim defining said upper shoulder edge.

3. A cosmetic stick holder, comprising:

a cosmetic stick mechanism which includes a) a screwing sleeve which has a thread groove, b) a slot sleeve which is received within said screwing sleeve and which includes both an axially extending slot and a foot part formed at a first end of said slot sleeve, and c) a piston for carrying a cosmetic stick, said piston being positioned within said slot sleeve and including a lug that extends through the slot and into the thread groove such that relative rotation of said slot sleeve and screwing sleeve displaces said piston axially between an extended position and a retracted positions; and an outer cap member having an inner wall and a base which define an internal recess adapted to receive therein the foot part of said slot sleeve, said said cap member including a radial projection extending inwardly from the inner wall of said cap member, said foot part including a lower end and an axial shoulder, said axial shoulder being positioned above the lower end of said foot part and said axial shoulder being essentially axially aligned with said radial projection when said foot part is received within the internal recess of said cap member such that said axial shoulder is adapted to receive said radial projection, said foot part further including a first guiding groove extending from the first end of the foot part and opening into a first end of said axial shoulder, said foot part also including a second guiding groove opening out at the first end of said foot part and extending axially so as to open into a second end of said axial shoulder, said cosmetic stick holder further comprising an elastic part extending between the first end of said foot part and the base of said outer cap so as to axially bias said outer cap member away from said foot part so as to force said radial projection into contact with an edge of said axial shoulder so as to lock said cap member to said foot part until relative rotation of said cap member and foot part positions said radial projection out of locking engagement with said axial shoulder and into said second guiding groove whereby said outer cap member is axially displaceable with respect to said foot part.

4. A cosmetic stick holder as recited in claim 3 wherein said axial shoulder includes a snapping depression and said radial projection is in the form of a lug member that is dimensioned for receipt within said snapping depression.

5. A cosmetic stick holder as recited in claim 3 wherein said elastic part is an elastically yielding tongue extending off from the base of said outer cap member, the lower end of said foot part including a recess and said tongue including an end projection which is dimensioned for receipt within the recess formed in the lower end of said foot part.

6. A cosmetic stick holder as recited in claim 3 wherein said first guiding groove extends obliquely with respect to the axial direction such that the foot part can be screwed into the outer cap member upon said radial projection travelling along said fist guiding groove.

7. A cosmetic stick holder, comprising:

a cosmetic stick mechanism which includes a) a screwing sleeve which has a thread groove, b) a slot sleeve which is received within said screwing sleeve and which includes both an axially extending slot and a foot part formed at a first end of said slot sleeve, and c) a piston for carrying a cosmetic stick, said piston being positioned within said slot sleeve and including a lug that extends through the axially extending slot and into the thread groove such that relative rotation between said lot sleeve and screwing sleeve displaces said piston axially between an extended position and a retracted position;

an outer cap member which includes an interior adapted to receive the first end of said slot sleeve, and said screwing sleeve being dimensioned and arranged so as to be rotatable with respect to said outer cap member such that said piston is axially displaceable into said extended position upon rotation of said screwing sleeve in a first direction and into said retracted position upon rotation of said screwing sleeve in a second direction, and said cosmetic stick mechanism is releasably engaged with said outer cap member by a releasable lock, and said releasable lock comprising a first lock part associated with said cap member and a second lock part associated with said foot member, and said first and second lock parts being dimensioned and arranged such that said cap member and foot part are axially held together while said releasable lock is in a locking state and such that, upon relative rotation between said cap member and said foot part while said piston is in said retracted position, said releasable lock is placed in a disengagement state wherein said cap member is freely removable from said cosmetic stick mechanism, and one of said locking parts being a radial projection and the other of said locking parts being an axial shoulder which forms a seat for supporting the radial projection, said radial projection being axially lockable with the axial shoulder and unlockable from the axial shoulder by a relative rotation of the outer cap member on the one hand and of the foot part via the screwing sleeve on the other hand when the piston is held in said retracted position, and wherein axially between said foot part and said outer cap member there is positioned an elastic part pushing said foot part and outer cap member axially apart, and wherein the elastic part is formed as an elastically yielding tongue formed with a projection eccentrically arranged with respect to a central axis of the screwing sleeve, said projection (12) being engaged with a complementary recess formed in said cosmetic stick holder.

8. A cosmetic stick holder, comprising:

a cosmetic stick mechanism which includes a) a screwing sleeve which has a thread groove, b) a slot sleeve which is received within said screwing sleeve and which includes both an axially extending slot and a foot part formed at a first end of said slot sleeve, and c) a piston for carrying a cosmetic stick, said piston being positioned within sad slot sleeve and including a lug that extends through the axially extending slot and into the thread groove such that relative rotation between said slot sleeve and screwing sleeve displaces said piston axially between an extended position and a retracted position;

an outer cap member which includes an interior adapted to receive the first end of said slot sleeve, and said screwing sleeve being dimensioned and arranged so as to be rotatable with respect to said outer cap member such that said piston is axially displaceable into said extended position upon rotation of said screwing sleeve in a first direction and into said retracted position upon rotation of said screwing sleeve in a second direction, and said cosmetic stick mechanism is releasably engaged with said outer cap member by a releasable lock, and said releasable lock comprising a first lock part associated with said cap member and a second lock part associated with said foot member, and said first and second lock parts being dimensioned and arranged such that said cap member and foot part are axially held together while said releasable lock is in a locking state and such that, upon relative rotation between said cap member and said foot part while said piston is in said retracted position, said releasable lock is placed in a disengagement state wherein said cap member is freely removable from said cosmetic stick mechanism, and one of said locking parts being a radial projection and the other of said locking parts being an axial shoulder which forms a seat for supporting the radial projection, said radial projection being axially lockable with the axial shoulder and unlockable from the axial shoulder by a relative rotation of the outer cap member on the one hand and of the foot part via the screwing sleeve on the other hand when the piston is held in said retracted position, and wherein axially between said foot part and said outer cap member there is positioned an elastic part pushing said foot part and outer cap member axially apart, and wherein said cosmetic stick mechanism has a guiding groove adapted to receive in sliding fashion the radial projection formed as a round lug, said guiding groove having a first end which opens at one side of the axial shoulder, and the guiding groove being axially open at an end opposite to said first end.

9. Cosmetic stick holder according to claim 8, wherein the elastic part is formed as an elastically yielding tongue (11) formed with a projection (12) eccentrically arranged with respect to a central axis of the screwing sleeve (5), said projection (12) being engaged with a complementary recess (13) formed in said cosmetic stick holder.

10. Cosmetic stick holder according to claim 8, wherein the axial shoulder (10) is shaped as a snapping depression and the radial projection (9) is shaped as a round lug.

11. Cosmetic stick holder according to claim 8, wherein the guiding groove (14) is extending obliquely with respect to the axial direction such that a foot part (3) can be screwed into the outer cap member (8) with the same direction of rotation as the direction of rotation required for axial locking the radial projection (9) at the axial shoulder (10).

12. Cosmetic stick holder according to claim 8, wherein at an opposite side of the axial shoulder (10) there is provided a second guiding groove (15) with a first end that opens into said axial shoulder, the second guiding groove (15) being axially open at a second end opposite to the first end such that, upon rotation of said round lug (9), to the first end of said second guiding groove, said round lug is axially displaceable along said second guiding groove and out past the second end of said guiding groove.

13. Cosmetic stick holder according to claim 12, wherein the second guiding groove (15) is formed at that side of the axial shoulder (10) which is downstream of the first end of said axial shoulder with respect to rotation in the second direction such that further rotation in the second direction when the piston is in the retracted position places said round lug in said second guiding groove.

14. A cosmetic stick holder, comprising:

a cosmetic stick mechanism which includes a) a screwing sleeve which has a thread groove, b) a slot sleeve which is received within said screwing sleeve and which includes both an axial slot and a foot part formed at a first end of said slot sleeve, and c) a piston for carrying a cosmetic stick, said piston being positioned within said slot sleeve and including a lug that extend through the axial slot and into the thread groove such that relative rotation between said slot sleeve and screwing sleeve displaces said piston axially between an extended position and a retracted position;

an outer cap member which includes an interior adapted to receive the first end of said slot sleeve, and said screwing sleeve being dimensioned and arranged so as to be rotatable with respect to said outer cap member such that said piston si axially displaceable into said extended position upon rotation of said screwing sleeve in a first direction and into said retracted position upon rotation of said screwing sleeve in second direction, and said cosmetic stick mechanism is releasably engaged with said outer cap member by a releasable lock, and said releasable lock comprising a first lock part associated with said cap member and a second lock part associated with foot member, and said first and second lock parts being dimensioned and arranged such that said cap member and foot part ar axially held together while said releasable lock is in a locking state and such that, upon relative rotation between said cap member and said foot part while said piston is in said retracted position, said releasable lock is placed in a disengagement state wherein said cap member is freely removable from said cosmetic stick mechanism, and said outer cap member including an inner wall and a bottom and said first and second lock parts being comprised of a radial projection and an axial shoulder with said radial projection and said axial shoulder being essentially equally axially spaced from the bottom of said cap member when said foot part is received within said cap member such that contacting portions of said first and second lock parts are axially aligned, said radial projection extending inwardly off of the inner wall of said cap member and said axial shoulder being formed in said foot part, and said foot part including a first guiding groove extending obliquely and opening into a first end of said axial shoulder and said foot part including a second guiding groove extending axially and opening at one end into a second end of said axial shoulder and opening out of said foot part at an opposite end.

15. A cosmetic stick holder, comprising:

a cosmetic stick mechanism which includes a) a screwing sleeve which has a thread groove, b) a slot sleeve which is received within said screwing sleeve and which includes both an axial slot and a foot part formed at a first end of said slot sleeve, and c) a piston for carrying a cosmetic stick, said piston being positioned within said slot sleeve and including a lug that extends through the axial slot and into the thread groove such that relative rotation between said slot sleeve and screwing sleeve displaces said piston axially between an extended position and a retracted position;

an outer cap member which includes an interior adapted to receive the first end of said slot sleeve, and said screwing sleeve being dimensioned and arranged so as to be rotatable with respect to said outer cap member such that said piston is axially displaceable into said extended position upon rotation of said screwing sleeve in a first direction and into said retracted position upon rotation of said screwing sleeve in a second direction, and said cosmetic stick mechanism is releasably engaged with said outer cap member by a releasable lock, and said releasable lock comprising a first lock part associated with said cap member and a second lock part associated with said foot member, and said first and second lock parts being dimensioned and arranged such that said cap member and foot part are axially held together while said releasable lock is in a locking state and such that, upon relative rotation between said cap member and said foot part while said piston is in said retracted position, said releasable lock is placed in a disengagement state wherein said cap member is freely removable from said cosmetic stick mechanism, and wherein one of said locking parts is a radial projection (9) and the other of said locking parts is an axial shoulder (10) which forms a seat for supporting the radial projection (9), which radial projection (9) can axially be locked at and unlocked from the axial shoulder (10) by a relative rotation of the outer cap member (8) on the one hand, and of the foot part (3) via the screwing sleeve (5) on the other hand, when the piston is held in said retracted position, and wherein axially between said foot part (3) and said outer cap member (8) there is positioned an elastic part (11) pushing said foot part and outer cap member axially apart, and said axial shoulder being shaped as a snapping depression and the radial projecting being shaped as a round lug.

16. Cosmetic stick holder according to claim 15, wherein the axial shoulder (10) has a guiding groove (14) adapted to receive in sliding fashion the radial projection (9) formed as a round lug, said guiding groove having a first end which opens at one side of the axial shoulder (10), and the guiding groove being axially open at an end opposite to said first end.

* * * * *